United States Patent [19]

Held

[11] 4,232,609

[45] Nov. 11, 1980

[54] PROXIMITY FUSE

[75] Inventor: Manfred Held, Kühbach, Fed. Rep. of Germany

[73] Assignee: Messerschmitt-Bölkow-Blohm GmbH, Munich, Fed. Rep. of Germany

[21] Appl. No.: 506,328

[22] Filed: Sep. 12, 1974

[30] Foreign Application Priority Data

Sep. 20, 1973 [DE] Fed. Rep. of Germany ..... 2347374

[51] Int. Cl.[3] ..... F42C 13/04

[52] U.S. Cl. ..... 102/214

[58] Field of Search ..... 102/70.2 P; 343/7 PF; 244/3.15, 3.16, 3.19

[56] References Cited

U.S. PATENT DOCUMENTS

| | | | |
|---|---|---|---|
| 2,907,023 | 9/1959 | Skinner | 102/70.2 P |
| 3,332,077 | 7/1967 | Nard et al. | 102/70.2 P |
| 3,455,243 | 7/1969 | Martin | 102/70.2 P |
| 3,554,129 | 1/1971 | Alpers | 102/70.2 P |
| 3,562,752 | 2/1971 | Roeschke | 343/7 PF |
| 3,698,811 | 10/1972 | Weil | 343/7 PF |
| 3,774,213 | 11/1973 | Riggs | 102/70.2 P |
| 3,850,103 | 11/1974 | Krupen | 102/70.2 P |
| 3,858,207 | 12/1974 | Macomber et al. | 102/70.2 P |

*Primary Examiner*—Charles T. Jordan

*Attorney, Agent, or Firm*—Toren, McGeady and Stanger

[57] ABSTRACT

The proximity fuse is incorporated in a warhead carried by a missile. This warhead comprises several active or passive bodies, which consist of preformed splinters or shaped charges. The proximity fuse comprises a circuit for producing an ignition signal to start the decomposition of the warhead when a distance is reached between the warhead and a target, for instance a missile. This distance is determined by using electromagnetic waves. The circuit comprises means for determining the time $t_A$, which will elapse before the warhead encounters the target. Moreover, the circuit comprises means for storing a constant reference time $t_B$, which is fixed in such a way that the active or passive bodies released within a certain space sector when the warhead decomposes, will be scattered in a certain space, i.e. they will cover this space in front of the target within this reference time. The circuit also comprises means for comparing the calculated time with the constant reference time being provided. The ignition signal for starting the decomposition of the warhead is released on the strength of this comparison as soon as the calculated time becomes shorter than the reference time.

Reference time $t_B$ can be adjusted to different values. To determine distance A and the relative speed $v_B$ between warhead and target at the moment of encounter either the travel time of a pulse which is reflected by the target or the Doppler frequency shift between transmitted and reflected signal is used. A computer can also be provided for determining the dimensions of the attacking target.

6 Claims, 5 Drawing Figures

PROXIMITY FUSE

BACKGROUND OF THE INVENTION

When using guided or target-seeking missiles with a decomposable warhead, in particular against flying targets, hits by ramming can generally not be expected because of the limited accuracy of the guidance system. For this reason, missiles with decomposable warheads are equipped with electromagnetic proximity fuses. To derive the ignition command for the warhead, use is made, for instance, of the falling below a predetermined minimum distance, cf. DT-OS No. 1 578 510, or of the falling below an adjusted constant of a Doppler frequency if the fuse is equipped with a Dopplar radar.

It has been found that warheads with several active or passive bodies, which can be scattered within a certain space sector have a minimum range probable error and an optimum hit efficacy when the individual bodies of the warhead cover a limited space when encountering the target where—according to experience—the mean distance of the bodies from each other shall be somewhat smaller than the diameter of the sensitive portion of the flying target.

However, such an optimization cannot be achieved with known fuses, since the abovementioned space covered by said bodies of the warhead depends on the relative speed at which the missile and the target encounter and will therefore have too small or too large a cross-section at the moment of encountering. In both cases a reliable destruction of the target is not guaranteed.

It has therefore been suggested, cf. DT-OS No. 2 206 403, to start the decomposition of the warhead at an early time and to connect the individual active or passive bodies after this decomposition by means of a holding or carrying structure. The individual active or passive bodies can thus cover the given optimum space sector before encountering the target and they can keep their positions until encountering the target.

SUMMARY OF THE INVENTION

This invention relates to a proximity fuse for a warhead carried by a missile. Said warhead houses several active or passive bodies, such as preformed splinters or shaped charges. The proximity fuse comprises a circuit for producing an ignition signal to start the decomposition of the warhead when a certain distance is reached between warhead and target that had been determined by means of electromagnetic waves. The warhead decomposes in such a way that—without using a holding or connecting structure for the bodies—the space covered by said bodies when encountering the target is independent of the relative speed between warhead and target and represents an optimum.

Based upon a proximity fuse of the type mentioned above this objective is achieved, in accordance with the invention, by providing the circuit with means for determining the time $t_A$, which will elapse before the warhead encounters the target, and with means for storing a constant reference time being fixed in such a way that the bodies released within a certain space sector will cover a given space within this reference time. Moreover, means are provided for comparing the calculated time with the reference time. The ignition signal for starting the decomposition of the warhead is releaseable on the strength of this comparison as soon as the calculated time becomes shorter than the reference time.

Since the decomposition speed of the released active or passive bodies is known and is reproducible and since the decomposition of the warhead is always started at a constant reference time before encountering the target independently of the relative speed between warhead and target, the same covering density of the active or passive bodies with respect to the dimensions of the target to be combated will always be achieved in the space at the moment when these bodies encounter the target. Hence the target to be combated always flies through the space which is optimally covered with said bodies so that the range probable error is reduced and the efficacy of hits is increased compared with known warheads.

In order to adapt the covering density of said bodies in every case to the dimensions of different targets, the constant reference time is adjustable to different values according to a preferred embodiment of the invention. If, for instance, a big flying target of a correspondingly large cross-section shall be intercepted by means of such a warhead, the constant reference time mentioned above will be adjusted to a correspondingly higher value, and hence the distance of the bodies from each other will be greater when said bodies encounter the target. The whole space covered by the active or passive bodies is thus enlarged, too. In the case of a small flying target the value of the constant reference time is reduced correspondingly, and hence the decomposition of the warhead will be started at a correspondingly later moment and the distance of the bodies from each other will be smaller when they encounter the target, and this distance will thus correspond to the smaller dimensions of the flying target. The value of the constant reference time can, for instance, be adjusted through commands from a ground station or independently by the missile on the strength of the reflection signals received from the target.

According to an embodiment of the invention the means for determining the time still remaining before the warhead encounters the target consist of a first apparatus for determining the distance and a second apparatus for determining the relative speed between warhead and target as well as of a quotient computer for the output signals supplied by the two apparatuses.

For determining the distance and the relative speed between warhead and target a pulse generator with a definite pulse period has been provided, in which case the distance of the warhead from the target is calculated in a known way from the travel time of a transmitted pulse between warhead and target, and the relative speed between warhead and target is calculated via several determinations of the distance according to the following formula:

$$v_B = \frac{(t_1 - t_n) \cdot c}{2 \cdot n \cdot T}$$

where c is the velocity of light, T is the pulse period of the pulse generator, e.g. a pulse radar, and $t_1$ and $t_n$, respectively, is the travel time of the first and of the $n^{th}$ pulse, respectively, that had been transmitted and received again. $t_1$ and $t_n$, respectively must be chosen smaller than the pulse period of the pulse generator.

Whether a determination during several pulse periods, for instance n=4, is suitable, depends on the chosen pulse frequency of the pulse generator. If this pulse frequency is very high so that the distance will vary only slightly in the course of several measurements, the relative speed should be determined during several pulse periods of the pulse generator, because the following quotient formation of the distance and of the relative speed in the quotient computer depends directly on the error of the relative speed.

According to another embodiment of the invention, the distance and the relative speed can be determined by a pulsed Doppler radar. In this case, the distance is determined by measuring the travel time, while the relative speed is determined by comparing the frequencies of the transmitted pulse and of the pulse reflected by the target.

The release time for the decomposition of the warhead given by the constant reference time and depending on the dimensions of the target is determined according to a preferred embodiment of the invention in that a computer is provided for determining the dimensions of the target to be attacked from the intensity of the pulse reflected by the target and that a control circuit fed by the computer is provided to vary the constant reference time.

An object of the invention is to provide an improved proximity fuse which always releases at a given fixed time difference independently of the relative speed between warhead and target at the encounter moment.

Another object of the invention is to provide such a proximity fuse which is of lightweight construction for the mission of the missile, consists of few components, and works reliably.

A further object of the invention is to provide a proximity fuse for which the distance between the warhead carried by the missile and the target is obtained from the travel time of the reflected pulse, and the relative speed between warhead and target at the encounter moment is obtained from the difference of the distance measurements.

A further object of the invention is to provide a proximity fuse for which the relative speed between the warhead carried by the missile and the target at the encounter moment is directly obtained from the doppler frequency of a Doppler radar pulse transmitter.

Another object of the invention is to provide such a proximity fuse with a computer to determine the dimensions of the target to be attacked from the intensity of the reflected pulse.

For an understanding of the principles of the invention, reference is made to the following description of two typical embodiments thereof as illustrated in the accompanying drawings.

DESCRIPTION OF PREFERRED EMBODIMENTS

Figure 1A:
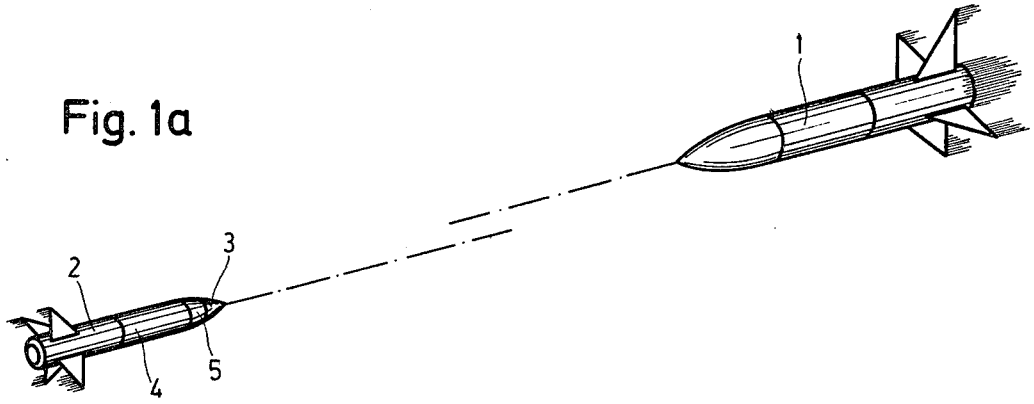
FIGS. 1*a* to 1*c* show the decomposable warhead incorporated in an interceptor missile when flying towards the target up to its destruction.
Figure 1B:
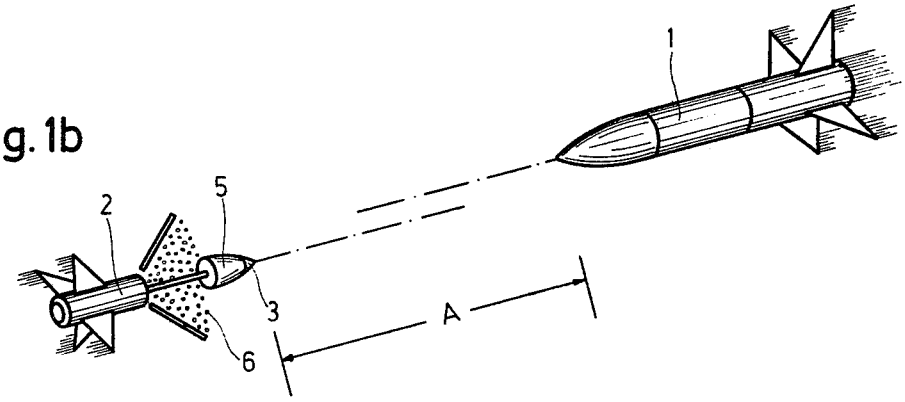
Figure 1C:
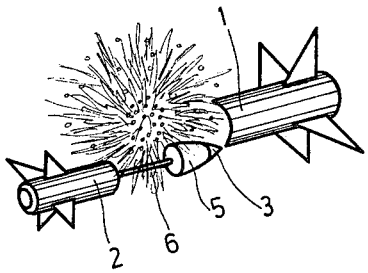

In order to intercept a flying target, e.g. a tactical or strategic ballistic missile 1, an interceptor missile 2 is launched and guided into opposite course to missile 1 in the last approach phase by means of an active target seeker 3. Interceptor missile 2 is provided with a decomposable warhead 4, the decomposition of which is started by means of a proximity fuse 5. Proximity fuse 5, which may be a part of the active target seeker 3, continuously calculates the time still remaining until interceptor missile 2 encounters ballistic missile 1 and thus calculates a distance A from missile 1. As soon as this calculated time corresponds to a preselectable constant reference time, the decomposition of the warhead is started, e.g. by means of a fuse, which is not shown here, see FIG. 1*b*. Warhead 4 consists, for instance, of a plurality of individual shaped charges 6 which move at a reproducible decomposition speed within the predetermined space sector alongside interceptor missile 2 during the time still remaining until the missiles encounter. At the encounter moment, see FIG. 1*c*, the warhead has decomposed so far that the individual shaped charges 6 are at a distance from each other which is somewhat smaller than the diameter of missile 1. As soon as missile 1 immerses into the space covered by shaped charges 6, i.e. in which shaped charges 6 are distributed, said missile will be destroyed.

Figure 2:
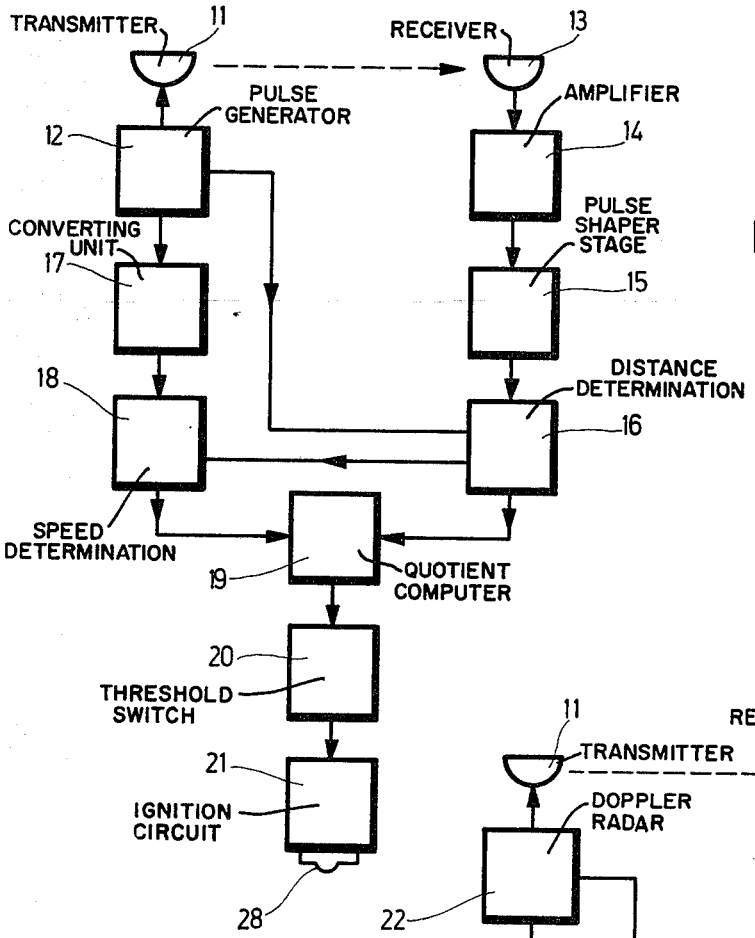
FIG. 2 is a block diagram of a first embodiment of a proximity fuse according to the invention and FIG. 3 is a block diagram of a second embodiment of the invention.

According to FIG. 2, proximity fuse 5 has a transmitter 11, which is triggered by a pulse generator 12, that works with a frequency of between 30 and 10,000 c/s. Transmitter 11 may be a high-frequency pulse generator or an optical pulse light source, such as a Laser or an infrared light source. As soon as a pulse transmitted by transmitter 11 hits the target, i.e. missile 1, this pulse will be reflected and received in proximity fuse 5 by receiver 13, amplified by amplifier 14 and from there fed to pulse-amplifier stage 15.

Distance A between transmitter 11 and missile 1 to be intercepted is given by half the travel time t between the transmission and the reception of the pulse multiplied by the velocity of propagation (velocity of light). This determination of this distance is done in an apparatus 16, in which case travel time t can be determined both analogously and digitally. An analogous determination, for instance, can be achieved by starting to charge a capacitor by means of pulse generator 12 and by stopping to charge the capacitor by means of triggering from pulse shaper 15, while the digital determination can be achieved by starting a counter, which is connected to pulse generator 12, and by stopping this counter by means of pulse shaper 15. Moreover, pulse generator 12 operates a converting unit 17, which controls an apparatus for speed determination 18. Whether converting unit 17 is necessary and suitable depends on the chosen pulse frequency. Since the respective relative speed $v_B$ will change only slightly, whereas the error shall be very small for the following quotient formation, it is suitable to determine the relative speed through a long time because of the high accuracy required. For this reason, the speed should not be determined by means of the pulse frequency, but with better accuracy through converting unit 17 at greater time intervals.

In the apparatus for the speed determination 18, distance $A_1$ is at first stored at a time $t_1$ and subtracted from distance $A_2$ measured at the time $t_2$. The relative speed $v_B$ between missile and target when encountering is determined by dividing the difference of the distances $A_1-A_2$ and the difference of the times $t_2-t_1$, which is given by the frequency of pulse generator 12 multiplied by the adjusted conversion ratio. Distance A and relative speed $v_B$ are supplied to a quotient computer 19, which determines the time $t_A$ up to the encounter of interceptor missile and target from the quotients of A and $v_B$. With decreasing distance A and with the relative speed $v_B$ being constant in first approximation, quotient value $t_A$ will devlop from a great value towards a small value in accordance with the decreasing time up to the encounter of the interceptor missile and the target. Times $t_A$ determined continuously in quotient computer 19 are supplied as voltage signals to threshold switch 20 connected at the output, the threshold voltage of which characterizes an adjustable constant time or reference time $t_B$. As soon as time $t_1$ reaches reference time $t_B$, threshold switch 20 triggers an ignition circuit 21, which—on its part—makes an electrical ignition cap 28 respond, which causes the decomposition of warhead 4 with its slave charges 6.

Figure 3:
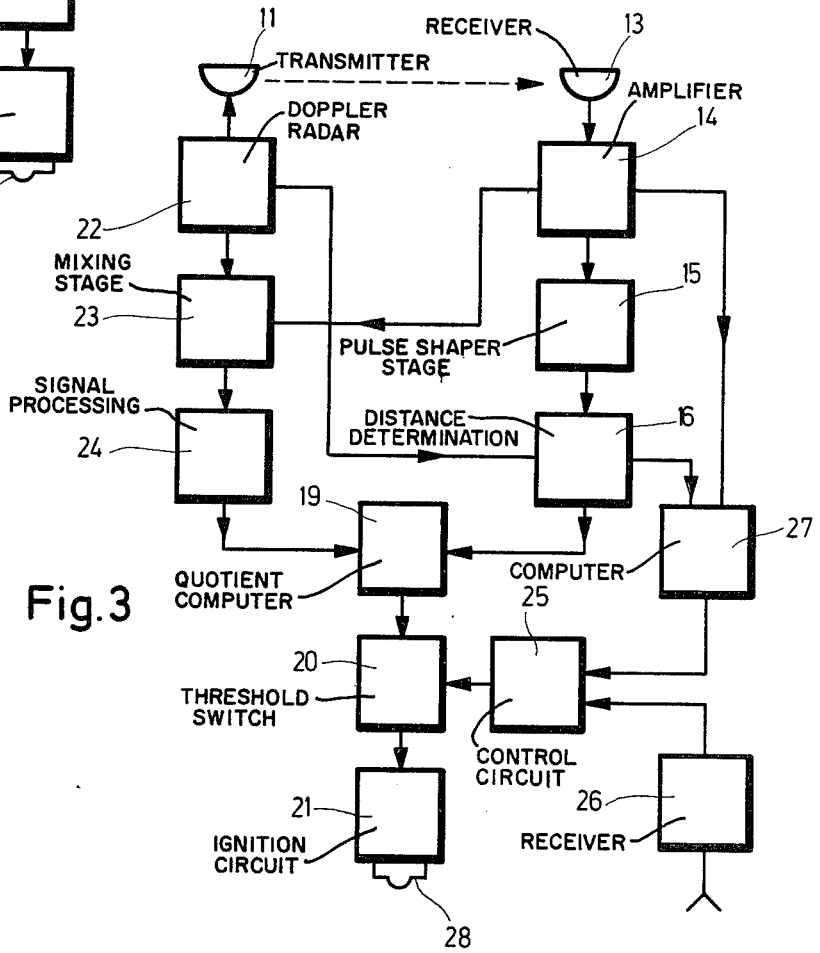

FIG. 3 shows a modified embodiment of the invention with a pulsed Doppler radar 22. In this case, a Doppler radar pulse signal is given to transmitter 11. The signal, which is reflected by the target, is received in receiver 13 and amplified correspondingly in amplifier 14. As in the case of FIG. 2, distance A is determined by measuring the travel time and by comparing the output signal of pulse generator 22 with the input signal of receiver 13, which is given into apparatus 16 for the determination of the distance via amplifier 14 and pulse shaper 15. In contrast to FIG. 2, relative speed $v_B$ is determined directly from the frequency shift of the amplified reflected signal by comparison with the output signal in a mixing stage 23. The output signal from mixing stage 23 being equivalent to relative speed $v_B$ has still to be processed for quotient computer 19 in a separate apparatus 24. Time $t_A$ determined in quotient computer 19 is again supplied to threshold switch 20 which triggers ignition circuit 21 when reference time $t_B$ is reached.

Moreover, FIG. 3 provides a possibility to change reference time $t_B$ in threshold switch 20 by changing the threshold voltage. Release distance A between interceptor missile 2 and target 1, at which warhead 4 is decomposed, is varied by changing reference time $t_B$. The threshold voltage can be increased and reduced, respectively, by a control circuit 25, in which case pulses are fed to the control circuit through external commands, which are received and processed by a receiver 26.

Since, in the system according to the invention, distance A is determined directly from the travel time of the pulse, the dimensions of the target can moreover be estimated as a function of distance A by means of the intensity of the signal received in receiver 13. This estimation or valuation is made in computer 27, into which are given the input signal from amplifier 14 and distance A from apparatus 16. Computer 27 can also suitably change reference time $t_B$ in threshold switch 20 through control circuit 25.

The system according to the invention can simultaneously form a part of the active target seeker 3 for the self-guidance (homing) of a missile, whereby the cost of the whole warhead can be reduced considerably. In the case of self-guidance, the knowledge of distance A and of relative speed $v_B$ permits to derive better guidance signals for the missile, if the angle formed by the longitudinal axes of the missile and of the target is measured additionally.

I claim:

1. A missile to be directed toward a target, comprising a warhead to release target destroying bodies into the path of the target, a proximity fuse coupled to the warhead and including transmitting-receiving means for transmitting electromagnetic waves toward a target and for receiving reflected electromagnetic waves from the target, said fuse including a circuit coupled to said transmitting-receiving means and responsive to said electromagnetic waves for producing an ignition signal to start the decomposition of the warhead when a distance is reached between the warhead and a target, said circuit having means for determining the time $t_A$ which will elapse before the warhead encounters the target, said circuit having means for storing a constant reference time $t_B$ so that when the warhead decomposes the bodies are released within a certain space sector and cover a given space in front of the target within the reference time and for comparing the determined time $t_A$ with the constant reference time $t_B$, said means for storing and comparing including a threshold device set to have a threshold corresponding to the time $t_B$, and means responsive to said means for storing and comparing for generating the ignition signal for starting the decomposition of the warhead on the strength of this comparison as soon as the determined time becomes shorter than the reference time.

2. A missile, as claimed in claim 1, having an apparatus for determining the time still remaining before the warhead encounters the target, said targets including a first apparatus for determining the distance and a second apparatus for determining the relative speed between warhead and target when encountering as well as of a quotient computer for the output signals supplied by these two apparatuses.

3. A missile to be directed toward a target, comprising a warhead to release target destroying bodies into the path of the target, a proximity fuse coupled to the warhead for decomposing the warhead, said proximity fuse including transmitting-receiving means for transmitting electromagnetic waves toward a target and for receiving reflected electromagnetic waves from the target, a circuit coupled to said transmitting-receiving means and said warhead and responsive to said electromagnetic waves for producing an ignition signal to start the decomposition of the warhead when the distance between the warhead and a target is less than a given value, said circuit having means for determining the time $t_A$ which will elapse before the warhead encounters the target, said circuit including means for storing a constant reference time $t_B$ and producing an output when $t_A = t_B$, said transmitting-receiving means including a pulsed Doppler radar arrangement to allow said circuit to determine the distance by measuring the travel time and to determine the relative speed by comparing the frequencies of the transmitted waves and of the waves reflected by the target.

4. A missile to be directed toward a target, comprising a warhead having target destroying bodies for release into the path of a target, a proximity fuse coupled to said warhead for dispersing the warhead and releasing the target destroying bodies, said proximity fuse including transmitting-receiving means for transmitting electromagnetic waves towards a target and for receiving reflected electromagnetic waves from the target, said fuse having circuit means coupled to said transmitting-receiving means and to said warhead for determining the time $t_A$ which will elapse before the warhead encounters the target and to store a constant time reference time $t_B$ so as to produce an output when $t_A = t_B$ to start the dispersal of the warhead when a given distance is reached between the warhead and a target, said circuit means including a pulse generator coupled to said transmitting receiving means for causing said transmitting receiving means to transmit the electromagnetic waves in pulses with a predetermined period, said circuit means including determining means coupled to said transmitting receiving means for determining the times $t_1 \ldots t_n$ which the first, . . . $n^{th}$ transmitted pulses each took to be transmitted and received so as to determine the instantaneous distance A between the warhead and the target, said circuit means further including operating means for establishing the relative speed between the warhead and the target according to the following formula:

$$v_B = \frac{(t_1 - t_n) \cdot c}{2 \cdot n \cdot T}$$

wherein c is the velocity of light, T is the pulse period of the pulse generator, and $t_1$ and $t_n$ are each smaller than T.

5. A proximity fuse for a missile to be directed toward a target and decompose a warhead to release target destroying bodies in the path of the target, comprising transmitting-receiving means for transmitting electromagnetic waves toward a target and for receiving reflected electromagnetic waves from the target, said fuse including a circuit coupled to said transmitting-receiving means and responsive to said electromagnetic waves for producing an ignition signal to start the decomposition of the warhead when a distance is reached between the warhead and a target, said circuit having means for determining the time $t_A$ which will elapse before the warhead encounters the target, said circuit having means for storing a constant reference time $t_B$ so that when the warhead decomposes the bodies are released within a certain space sector and cover a given space in front of the target within the reference time and for comparing the determined time $t_A$ with the constant reference time $t_B$, said means for storing and comparing including a threshold device set to have a threshold corresponding to the time $t_B$, means responsive to said means for storing and comparing for generating the ignition signal for starting the decomposition of the warhead on the strength of this comparison as soon as the determined time becomes shorter than the reference time, and means for adjusting the constant reference time to different values.

6. A proximity fuse for a missile to be directed toward a target and arranged to carry and decompose a warhead to release target destroying bodies into the path of the target, said proximity fuse comprising transmitting-receiving means for transmitting electromagnetic waves toward a target and for receiving reflected electromagnetic waves from a target, a circuit coupled to said transmitting-receiving means and responsive to said electromagnetic waves for producing an ignition signal to start the decomposition of the warhead when a distance is reached between the warhead and a target said circuit having means for determining a time $t_A$ which will elapse before the warhead encounters the target, said circuit including means for storing a constant reference time $t_B$ whose value is such that the bodies released cover a given space in front of the target within the reference time $t_B$ and for comparing the determined time with the constant reference time, and means for starting the decomposition of the warhead on the strength of this comparison as soon as the determined time becomes shorter than the reference time, metering means to determine the dimensions of the target to be attacked from the intensity of a wave reflected by the target and serving for determining the distance, and a control circuit fed by the metering means to vary the constant reference time.

* * * * *